343-754 SR
9/11/84 OR 4,471,359

United States Patent [19]

Howard

[11] Patent Number: 4,471,359

[45] Date of Patent: Sep. 11, 1984

[54] DUAL BAND, LOW SIDELOBE, HIGH EFFICIENCY MIRROR ANTENNA

[75] Inventor: Dean D. Howard, Fort Washington, Md.

[73] Assignee: The United States of America as represented by the Secretary of the Navy, Washington, D.C.

[21] Appl. No.: 388,563

[22] Filed: Jun. 15, 1982

[51] Int. Cl.[3] ..... H01Q 19/06; H01Q 19/195

[52] U.S. Cl. ..... 343/754; 343/756; 343/779; 343/781 P; 343/909

[58] Field of Search ..... 343/756, 786, 754, 779, 343/781 P, 909

[56] References Cited

U.S. PATENT DOCUMENTS

| | | | |
|---|---|---|---|
| 2,958,863 | 11/1960 | Ramsay . | |
| 3,005,983 | 10/1961 | Chandler | 343/756 |
| 3,281,850 | 10/1966 | Hannan | 343/756 |
| 3,754,272 | 8/1973 | Goldstone et al. | 343/786 |
| 3,924,239 | 12/1975 | Fletcher et al. | 343/909 |
| 4,070,678 | 1/1978 | Smedes | 343/754 |
| 4,220,957 | 9/1980 | Britt | 343/756 |

FOREIGN PATENT DOCUMENTS

| | | | |
|---|---|---|---|
| 1330175 | 8/1973 | United Kingdom | 343/756 |

*Primary Examiner*—Eli Lieberman
*Assistant Examiner*—K. Ohralik
*Attorney, Agent, or Firm*—Robert F. Beers; William T. Ellis; Alan P. Klein

[57] ABSTRACT

A dual band mirror antenna employing a continuous mirror without a hole. Side-by-side feeds for each band and an electromagnetic lens, located behind a rotatable twist reflector (the mirror), collimate beams toward a pair of polarized reflectors located near the twist reflector and tilted to aim the reflected energy toward the twist reflector. One polarized reflector is reflective at the higher radiofrequency band and transparent at the lower radiofrequency band. The other polarized reflector is reflective at both bands. Energy directed back toward the polarized reflectors from the twist reflector passes through the polarized reflectors to free space.

3 Claims, 2 Drawing Figures

DUAL BAND, LOW SIDELOBE, HIGH EFFICIENCY MIRROR ANTENNA

BACKGROUND OF THE INVENTION

The present invention relates generally to antennas for radiofrequency energy, and more particularly to antennas required to produce electromagnetic beams over wide angles of coverage volume.

U.S. Pat. No. 4,070,678 issued to Richard L. Smedes on Apr. 2, 1976 discloses a two-axis mirror antenna. This antenna has a fixed axial feed which illuminates a fixed wire grid parabola supported by a radome. The feed polarization is parallel to the grid wires of the parabola. The parabola forms the energy into a beam aimed back toward a mirror surrounding the feed. The mirror is a "half-wave plate" which rotates polarization 90° and reflects the beam into space through a spherical lens which collimates the beam. This energy, being polarized orthogonal to the grid wires forming the parabola, flows through the parabola with negligible attenuation. The echo from targets reverses the procedure to be focused onto the feed. The beam is moved by tilting the mirror, giving a beam shift of approximately twice the mirror tilt angle.

The mirror antenna is a very effective device for rapid large angle beam scanning, but the hole in the mirror for the feed limits sidelobe performance and causes some loss.

The prior art antenna is only capable of providing a beam of energy at wavelengths in a single radiofrequency band and there is no suggestion of modifying it for dual-band operation.

SUMMARY OF THE INVENTION

It is therefore an object of this invention to obtain very low sidelobes with a two-axis mirror antenna operating at two radiofrequency bands simultaneously.

Another object is to maximize the efficiency of a two-axis mirror antenna operating at two radiofrequency bands simultaneously.

These and other objects of the invention are achieved by a mirror antenna which includes first and second feed horns symmetrically disposed about a longitudinal axis for forming linearly-polarized divergent beams of energy at wavelengths in a higher and lower radiofrequency band respectively; an electromagnetic lens for simultaneously refracting and collimating the divergent beams; a first fixed polarized reflector for reflecting one beam while transmitting the other beam; a second fixed polarized reflector for reflecting the transmitted beam along the same path as travelled by the reflected beam; and a rotatably mounted twist reflector having a continuous reflecting surface for changing the direction of the reflected beams in accordance with the position of the twist reflector and for twisting their polarization by substantially 90° so that if the beams are directed back toward the polarized reflectors, the beams pass through the polarized reflectors to free space. Radiofrequency absorbent material may be added behind the lens to eliminate significant spillover lobes.

The use of a continuous reflecting surface in the mirror antenna design eliminates the loss of energy which occured in the prior art mirror antenna because of energy falling on the hole. The design allows a very low sidelobe device to collimate the beam with a minimum degradation of the pattern formed by the device. The two feed horns can be optimized individually and independently for optimum tapers, to further reduce sidelobes, and to maximize monopulse performance when the feed horns are used as monopulse feeds.

Additional advantages and features will become apparent as the subject invention becomes better understood by reference to the following detailed description when considered in conjunction with the accompanying drawing wherein:

DESCRIPTION OF THE PREFERRED EMBODIMENT

Figure 2:
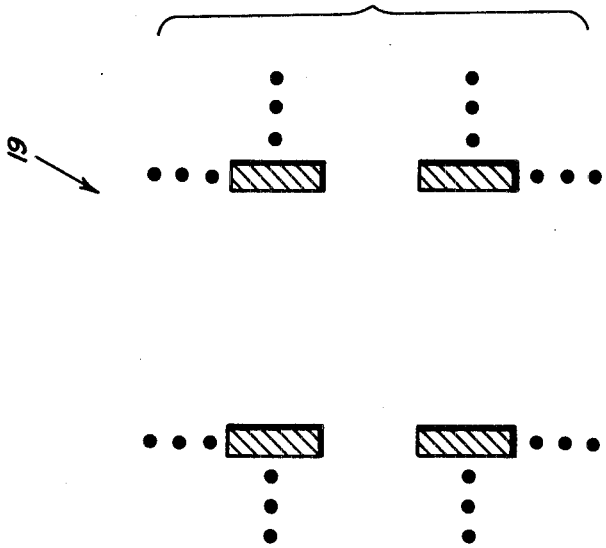
FIG. 2 shows a plan view of reflector 19.

Referring to the Figure, the dual-band mirror antenna 10 includes a higher-radiofrequency-band feed horn 11 and a lower-radiofrequency-band feed horn 13 symmetrically disposed about a longitudinal axis 15; an electromagnetic lens 17 disposed along the longitudinal axis in the path of beams from the feed horns; a polarized reflector 19, such as a dichroic grating, which is reflective at the higher radiofrequency band and transparent at the lower radiofrequency band, disposed in fixed spatial relationship to the electromagnetic lens; a polarized reflector 21, such as a grating, disposed behind the reflector 19 in fixed spatial relationship to the electromagnetic lens; and a twist reflector 23 which has a continuous reflecting surface and is rotatably mounted in the reflecting path of the reflectors 19 and 21.

Suitable twist reflectors 23 are described, for example, in the article "A Broad-Band Twist Reflector" by Lars G. Josefsson in *IEEE Trans. on Antennas and Propagation* (July 1971) pp. 552–554, whose disclosure is herewith incorporated by reference. The twist reflector 23 is mounted on a positioner 25 for rotation about two mutually perpendicular axis, such axes being perpendicular to the paper, and in the plane of the paper, respectively. A suitable positioner 25 is described, for example, in U.S. Pat. No. 3,374,977 issued to George Moy, Jr. on Mar. 26, 1968, herewith incorporated by reference.

Figure 1:
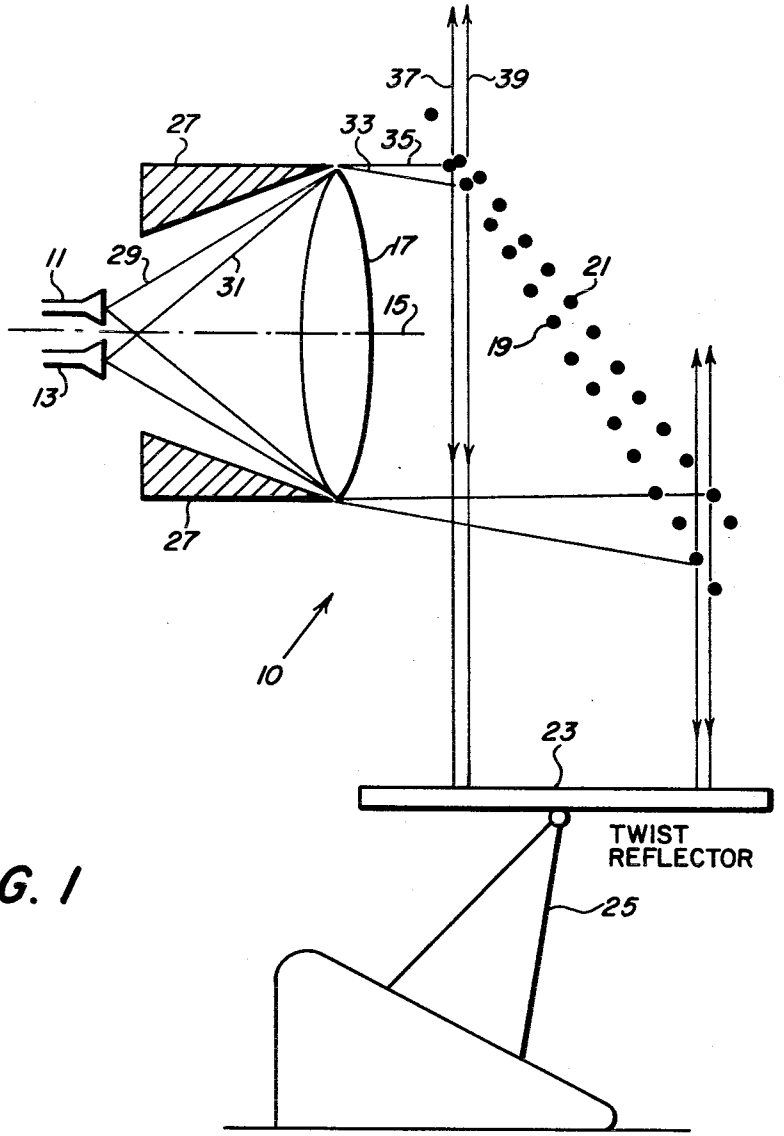
FIG. 1 illustrates an embodiment of the invention.

As shown in FIG. 1, radiofrequency absorbent material 27 can be disposed around the back of the electromagnetic lens 17.

Referring to FIG. 2, there is shown a plan view of a portion of reflector 19 which includes a two-dimensional array of conducting plates, whose dimensions and spacings determine the frequency band reflected by the reflector as is known in the art. Obviously, some supporting structure (not shown) should be provided to support the plate.

Details of the construction of this reflector and the theory of its performance may be found in the publication: Radio Science, Vol. 2 (New Series), No. 11, November 1967, page 1347–1359.

In operation, the feed horns 11 and 13 are connected to a transmitter (not shown). The feed horn 11 forms a linearly-polarized divergent beam 29 of energy at wavelengths in a higher radiofrequency band; and the feed horn 13 forms a linearly-polarized divergent beam 31 of energy at wavelengths in a lower radiofrequency band. The electromagnetic lens 17 simultaneously refracts and collimates the radiofrequency energy in each beam to produce a linearly-polarized collimated beam 33 of energy at wavelengths in the higher radiofrequency band and a linearly-polarized collimated beam 35 of energy at wavelengths in the lower radiofrequency band. The beams 33 and 35 are respectively offset one from the other. The linearly-polarized collimated beams illuminate the polarized reflector 19, the polarization being perpendicular to the plane of the paper, say "vertical". The polarized reflector 19 reflects the linearly-polarized collimated beam 33 of energy at wavelengths in the higher radiofrequency band onto the continuous surface of the twist reflector 23, while transmitting the linearly-polarized collimated beam 35 of energy at wavelengths in the lower radiofrequency band to the polarized reflector 21 which reflects the transmitted beam 35 onto the twist reflector 23 along the same path as travelled by beam 33. The twist reflector 23 changes the direction of the linearly-polarized collimated beams of radiofrequency energy in accordance with the position of the twist reflector, and twists the polarization of the radiofrequency energy in the collimated beams by 90 degrees. That is, the polarization of the radition reflected from the twist reflector 23 is made horizontal, or in the plane of the paper (the terms "vertical" and "horizontal" are used for convenience, not with any limiting force). Such radiation will, if directed back towards the polarized reflectors 19 and 21 as shown in FIG. 1, pass through to free space. By rotating the twist reflector 23 about mutually perpendicular axes, the beams 37 and 39 can be aimed into space over a large coverage volume.

The radiofrequency absorbent material 27 eliminates spillover sidelobes whose position in space is fixed, even though the main beams are moved by the twist reflector 23.

The surface of the twist reflector 23 is continuous, unlike that of the mirror for the feed in the antenna assembly shown in the above-cited U.S. Pat. No. 4,070,678 wherein energy is lost to the hole in the mirror. Furthermore, the absence of a mirror hole permits a reduction in sidelobe level.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. A dual band, low sidelobe, high efficiency mirror antenna comprising:

a first feed horn for forming a linearly-polarized divergent beam of energy at wavelengths in a higher radiofrequency band;

a second feed horn for forming a linearly-polarized divergent beam of energy at wavelengths in a lower radiofrequency band;

the first and second feed horns being symmetrically disposed about a longitudinal axis;

an electromagnetic lens disposed along the longitudinal axis in the path of the linearly-polarized divergent beams from the first and second feed horns for simultaneously refracting and collimating the radiofrequency energy in each beam to produce a linearly-polarized collimated beam of energy at wavelengths in the higher radiofrequency band and a linearly polarized collimated beam of energy at wavelengths in the lower radiofrequency band, the collimated beams being respectively offset one from the other;

a first polarized reflector, reflective at one radiofrequency band and transparent at the other radiofrequency band, disposed in fixed spatial relationship to the electromagnetic lens for reflecting the linearly-polarized collimated beam of energy at wavelengths in the one radiofrequency band while transmitting the linearly polarized collimated beam of energy at wavelengths in the other radiofrequency band;

a second polarized reflector disposed behind the first reflector in fixed spatial relationship to the electromagnetic lens for reflecting the transmitted linearly-polarized collimated beam of energy at wavelengths in the other radiofrequency band along the same path as travelled by the reflected linearly-polarized collimated beam of energy at wavelengths in the one radiofrequency band; and a twist reflector having a continuous reflecting surface and rotatably mounted in the path of the reflected linearly-polarized collimated beams for changing the direction of the linearly-polarized collimated beams of radiofrequency energy in accordance with the position of the twist reflector and for twisting the polarization of the radiofrequency energy in the collimated beams by substantially 90 degrees so that if the beams are directed back toward the first and second polarized reflectors, the beams pass through the first and second polarized reflectors to free space.

2. The mirror antenna recited in claim 1 including:

radiofrequency-absorbent material disposed at the electromagnetic lens to eliminate spillover sidelobes.

3. A high efficiency, low sidelobe method of directing dual band collimated beams of radiofrequency energy comprising the steps of:

forming a linearly-polarized divergent beam of energy at wavelengths in a higher radiofrequency band;

forming a linearly-polarized divergent beam of energy at wavelengths in a lower radiofrequency band;

simultaneously refracting and collimating the radiofrequency energy in each beam to produce a linearly-polarized collimated beam of energy at wavelengths in the higher radiofrequency band and a linearly-polarized beam of energy at wavelengths in the lower frequency band;

reflecting along the same path the linearly-polarized collimated beam of energy at wavelengths in the higher radiofrequency band and the linearly-polarized collimated beam of energy at wavelengths in the lower radiofrequency band;

changing the direction of the linearly-polarized collimated beams of radiofrequency energy; and twisting the polarization of the radiofrequency energy in the collimated beams by substantially 90 degrees.

* * * * *